US006988530B2

(12) United States Patent
Nikolovski

(10) Patent No.: US 6,988,530 B2
(45) **Date of Patent: *Jan. 24, 2006**

(54) STRIP CASTING

(75) Inventor: Nikolco Nikolovski, Figtree (AU)

(73) Assignee: Castrip LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/352,433

(22) Filed: Jan. 28, 2003

(65) Prior Publication Data

US 2003/0164229 A1 Sep. 4, 2003

Related U.S. Application Data

(63) Continuation-in-part of application No. 09/882,660, filed on Jun. 15, 2001, now Pat. No. 6,536,506.

(30) Foreign Application Priority Data

Jun. 15, 2000 (AU) ..... PQ8180

(51) Int. Cl.
*B22D 11/06* (2006.01)
*B22D 11/16* (2006.01)

(52) U.S. Cl. ..... 164/428; 164/154.2

(58) Field of Classification Search ..... 164/428, 164/480, 452, 154.2

See application file for complete search history.

(56) References Cited

U.S. PATENT DOCUMENTS 4,567,933 A 2/1986 Lauener et al.
4,649,986 A 3/1987 Frischknecht et al.
4,702,300 A * 10/1987 Nakanori et al. ..... 164/155.4
4,784,209 A 11/1988 Hlinka et al.
5,927,375 A * 7/1999 Damasse et al. ..... 164/451
6,164,366 A 12/2000 Fish et al.
6,167,942 B1 1/2001 Fish et al.
6,167,943 B1 1/2001 Fish et al.
6,397,924 B1 * 6/2002 Fish et al. ..... 164/480

(Continued)

FOREIGN PATENT DOCUMENTS

AU 737788 4/1999

(Continued)

OTHER PUBLICATIONS

Patent Abstract of Japan, vol. 018, No. 023 (M-1541), Jan. 14, 1994 & JP 05 261486 A (Hitachi Ltd.; others:01) Oct. 12, 1993; "Continuous Casting Apparatus for Strip"; Inventor: Yamashita Shinighi.

(Continued)

*Primary Examiner*—Kuang Y. Lin
(74) *Attorney, Agent, or Firm*—Arland T. Stein; Hahn, Loeser & Parks LLP

(57) ABSTRACT

Twin roll caster for casting thin steel strip comprises chilled casting rolls mounted on carriers. One roll is fixed and the other is moveable laterally and biased toward the other roll by carrier drive units acting on the moveable roll carriers. A casting pool of molten steel is supported on the rolls which are rotated to produce a solidified steel strip delivered downwardly from the nip therebetween. A substantially constant gap is maintained between the rolls such that unsolidifed molten metal passes through the nip between the solidified shells of the forming strip and solidifies below the nip. The carrier drive units are effective to apply to the biased roll substantially constant and low biasing forces, which may be between the same and slightly more than the force required to balance the hydrostatic pressure of the casting pool and to overcome the mechanical friction involved in moving the biased roll.

23 Claims, 8 Drawing Sheets

U.S. PATENT DOCUMENTS

| | | | | |
|---|---|---|---|---|
| 6,408,222 | B1 * | 6/2002 | Kim et al. | 700/155 |
| 6,474,403 | B1 * | 11/2002 | Nikolovski et al. | 164/452 |
| 6,536,506 | B2 * | 3/2003 | Nikolovski | 164/480 |
| 2002/0157807 | A1 * | 10/2002 | Nikolovski et al. | 164/454 |

FOREIGN PATENT DOCUMENTS

| | | | |
|---|---|---|---|
| EP | 1 025 931 | A2 | 8/2000 |
| JP | 59-193740 | | 2/1984 |
| JP | 60-083746 | | 5/1985 |
| JP | 60-145253 | * | 7/1985 |
| JP | 04-017958 | | 1/1992 |
| JP | 10-305352 | | 11/1998 |
| WO | WO 94/26443 | | 11/1994 |
| WO | WO 99/33595 | | 7/1999 |

OTHER PUBLICATIONS

Patent Abstract of Japan, vol. 009, No. 311 (M-346); Dec. 7, 1985; & JP 60 145253 A (Mitsubishi Jukogyo KK), Jul. 31, 1985; "Method for Exchanging Water Cooled Casting Roll in Continuous Casting Device"; Inventor: Tanif Masai-Une.

* cited by examiner

STRIP CASTING

CROSS REFERENCE TO RELATED APPLICATIONS

This application is a continuation-in-part of U.S. Ser. No. 09/882,660, filed Jun. 15, 2001, now U.S. Pat. No. 6,536,506, assigned to the same assignee as this application and now incorporated herein by reference, and which claims priority to and the benefit of Australian Application Serial No. PQ8180, filed Jun. 15, 2000.

BACKGROUND AND SUMMARY OF THE INVENTION

This invention relates to the casting of metal strip and making of cast steel strip. It has particular application to the casting of metal strip by continuous casting in a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to form a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

The setting up and adjustment of the casting rolls in a twin roll caster is a significant problem. The casting rolls must be accurately set to properly define an appropriate separation of the casting rolls at the nip, generally of the order of a few millimeters or less. There must also be some means for allowing at least one of the rolls to move outwardly against a biasing force to accommodate fluctuations in strip thickness particularly during start up.

Usually, one of the rolls is mounted in fixed journals, and the other roll is rotatably mounted on supports that can move against the action of biasing means to enable the roll to move laterally to accommodate fluctuations in casting roll separation and strip thickness. The biasing means may be in the form of helical compression springs or alternatively, may comprise a pair of pressure fluid cylinder units.

A strip caster with spring biasing of the laterally moveable roll is disclosed in U.S. Pat. No. 6,167,943 to Fish et al. In that apparatus, the biasing springs act between the roll carriers and a pair of thrust reaction structures, the positions of which can be set by operation of a pair of powered mechanical jacks to enable the initial compression of the springs to be adjusted to set initial compression forces which are equal at both ends of the roll. The positions of the roll carriers need to be set and subsequently adjusted after commencement of casting so that the gap between the rolls is constant across the width of the nip in order to produce a strip of constant profile. However, as casting continues the profile of the strip will inevitably vary due to eccentricities in the rolls and dynamic changes due to variable heat expansion and other dynamic effects.

Eccentricities in the casting rolls can lead to strip thickness variations along the strip. Such eccentricities can arise either due to machining and assembly of the rolls or due to distortion when the rolls are hot possibly due to non-uniform heat flux distribution. Specifically, each revolution of the casting rolls will produce a pattern of thickness variations dependent on eccentricities in the rolls and this pattern will be repeated for each revolution of the casting rolls. Usually the repeating pattern will be generally sinusoidal, but there may be secondary or subsidiary fluctuations within the generally sinusoidal pattern.

With improvements in the design of the casting rolls for a twin roll caster, particularly by the provision of textured surfaces which enable control of the heat flux at the interface between the casting rolls and the casting pool, it has been possible to achieve dramatic increases in strip casting speeds. However, when casting thin strip at high casting speeds there is an increased tendency to produce both high and low frequency gauge variations.

We have found that the gauge variations in cast strip can be alleviated by reducing the casting roll separation force and that the defect can be practically eliminated if the roll separation force is minimized. In practice there is at least a certain force that is required to balance the hydrostatic pool pressure and to overcome the mechanical friction involved in moving the rolls. We have also found that the high frequency gauge variation can be overcome, and a unique cast steel strip can be produced, by reducing the strip stiffness in the region of the nip by allowing a quantity of mushy or molten metal to be passed through the nip between the two solidified shells of the strip, by maintaining a roll gap at the nip slightly greater than the gap determined by the fully solidified shell thickness. It is desirable for these purposes that the mechanical friction forces involved in movement of the casting rolls relative to each other is minimized. By achieving very low strip stiffness, the dynamic interaction of the rolls on the strip is uncoupled, and consequently periodic gauge variation regeneration can be substantially reduced if not eliminated.

In at least one aspect, the present invention combines the features of applying a constant casting roll separation force (which can be small) and establishing a constant roll gap that will enable molten metal to be passed through the nip to further reduce strip stiffness. In order to maintain the constant separation force together with a constant roll gap, the invention may also allow for roll eccentricity compensation.

According to the invention there is provided an apparatus for continuously casting metal strip comprising a pair of parallel casting rolls forming a nip between them; metal delivery means to deliver molten metal into the nip between the rolls to form a casting pool of molten metal supported on casting roll surfaces immediately above the nip; pool confining means to confine the molten metal in the casting pool against outflow from the ends of the nip; and roll drive to drive the casting rolls in the counter-rotational directions to produce a solidified strip of metal delivered downwardly from the nip; wherein at least one of the casting rolls is mounted on a pair of moveable roll carriers which allow that one roll to move bodily toward and away from the other roll, wherein there is a pair of carrier drive units acting one on each of the pair of moveable roll carriers to bias said one roll bodily toward the other roll, and wherein each roll carrier drive unit comprises a thrust transmission structure connected to the respective roll carrier, a thrust reaction structure, a thrust generator acting between the thrust reaction structure and the thrust transmission structure to exert a thrust on the thrust transmission structure and the respective roll carrier, thrust reaction structure setting means operable to vary the position of the thrust reaction structure, and control means to control operation of the setting means so as to replicate a pattern of movement of the roll carriers due to roll eccentricities as an applied pattern of movements of the thrust reaction structure to maintain a constant roll biasing force, and roll gap control means operable to increase the gap between the rolls after said applied pattern of movements has been established.

The roll gap control means may be operable to produce an incremental increase of the roll gap in the range 0 to 50 microns. The roll gap control means may be operable to move said one roll. Alternatively, it may be operable to move the other casting roll. In other embodiments, to provide small roll separation force, the roll gap may be fixed and the casting speed may be varied until the requisite separation force is achieved. In that case, eccentricity compensation may be applied prior to providing speed adjustment.

The present invention may provide a unique cast steel strip with a composition as described in more detail below in the description of the embodiments described with reference to the drawings.

BRIEF DESCRIPTION OF THE DRAWINGS

Particular embodiments, and possible modifications, will be described in some detail with reference to the accompanying drawings in which.

DETAILED DESCRIPTION OF THE DRAWINGS

Figure 1:
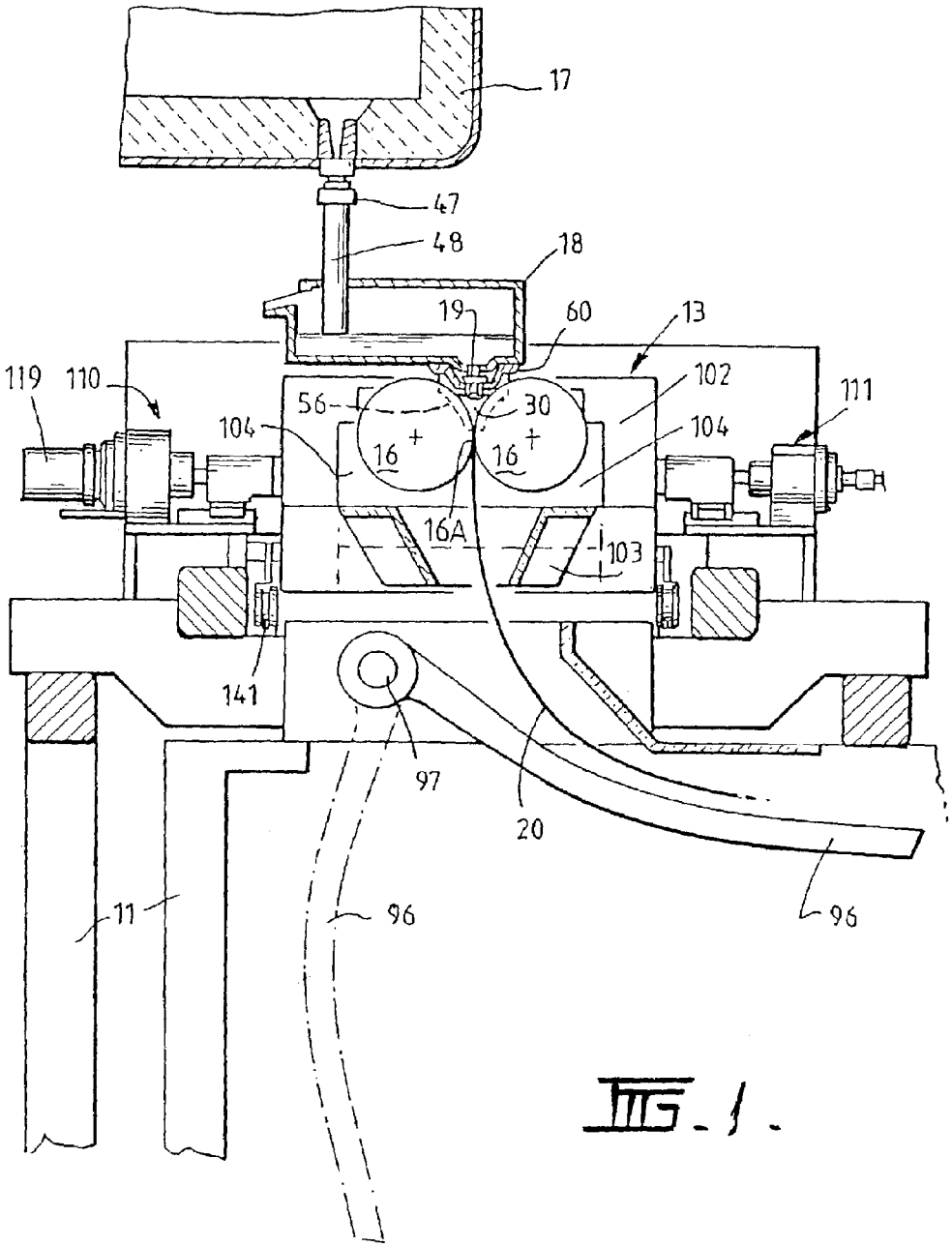
FIG. 1 is a vertical cross section through a strip caster constructed in accordance with the present invention.
Figure 2:
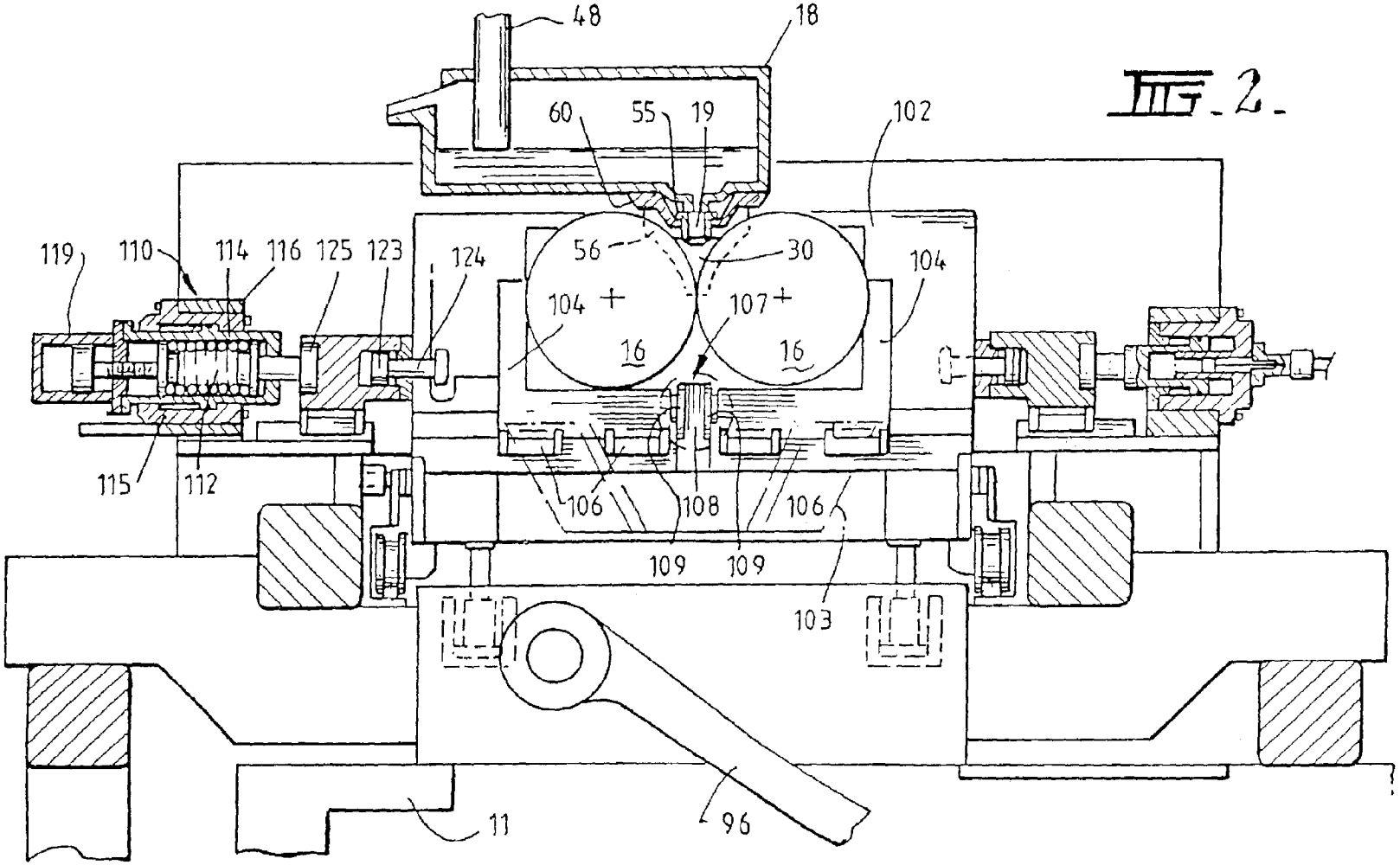
FIG. 2 is an enlargement of part of FIG. 1 illustrating particular components of the caster.
Figure 3:
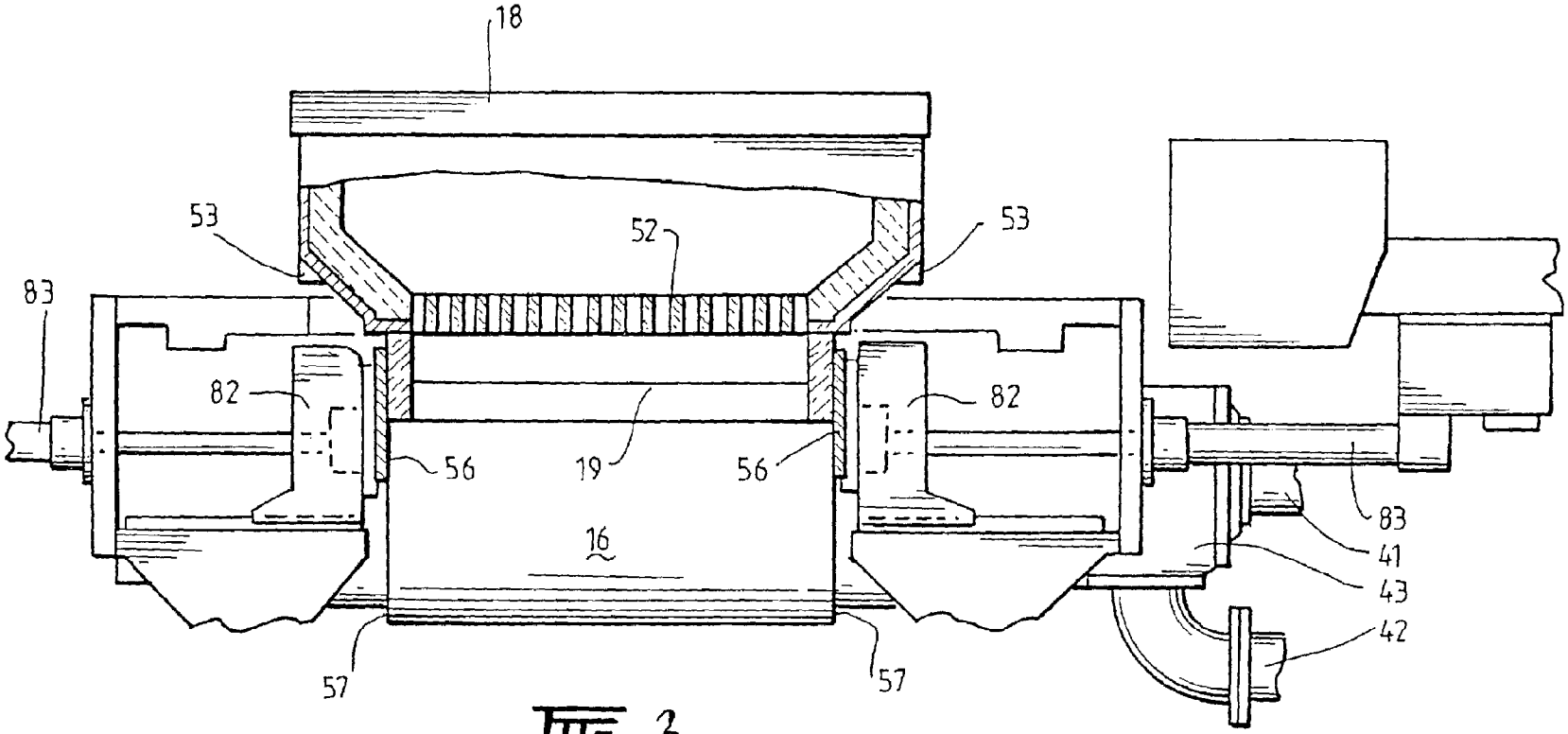
FIG. 3 is a longitudinal cross section through particular parts of the caster.

For the purposes of promoting an understanding of the principles of the invention, reference will now be made to the embodiments illustrated in the drawings and specific language will be used to describe same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The illustrative caster comprises a main machine frame 11 which stands up from the factory floor (not shown) and supports a casting roll module in the form of a cassette 13 which can be moved into an operative position in the caster as a unit but can readily be removed when the rolls are to be replaced. Cassette 13 carries a pair of parallel cooled casting rolls 16 having a nip 16A between them, to which molten metal is supplied during a casting operation from a ladle (not shown) via a tundish 17, molten metal distributor 18 and delivery nozzle 19 to create a casting pool 30. Casting rolls 16 are water cooled so that solidified shells form onto the moving roll surfaces and are brought together at the nip 16A between them to produce a solidified strip product 20 below the roll nip. This product may be fed to a standard coiler.

Casting rolls 16 are contra-rotated through drive shafts 41 from an electric motor and transmission mounted on the main machine frame. The drive shaft can be disconnected from the transmission when the cassette is to be removed. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm in diameter and about 2000 mm long in order to produce strip product approximately the width of the rolls.

A ladle of a conventional construction is supported on a rotating turret and a metal delivery system is provided by positioning the ladle over the tundish 17 to fill the tundish. The tundish may be fitted with a sliding gate valve 47 actuable by a servo mechanism to allow molten metal to flow from the tundish 17 through the valve 47 and refractory shroud 48 into molten metal distributor 18.

The molten metal distributor 18 may be formed as a wide dish made of a refractory material such as magnesium oxide (MgO). One side of the distributor 18 may receive molten metal from the tundish 17 and the other side of the distributor 18 may be provided with a series of longitudinally spaced metal outlet openings 52. The lower part of the distributor 18 carries mounting brackets 53 for mounting the distributor 18 onto the main frame 11 when the cassette 13 is installed in its operative position.

The metal delivery system also may have delivery nozzle 19 formed as an elongate body made of a refractory material such as alumina graphite. The lower part of nozzle 19 may be tapered so as to converge inwardly and downwardly so that it can project into the nip 16A between casting rolls 16. Its upper part may be formed with outwardly projecting side flanges 55 that locate on a mounting bracket 60 which forms part of the main frame 11.

Delivery nozzle 19 may have a series of horizontally spaced generally vertically extending flow passages to produce a suitably low velocity discharge of molten metal throughout the width of the casting rolls and to deliver the molten metal into the nip 16A between the casting rolls without direct impingement on the roll surfaces at which initial solidification occurs. Alternatively, delivery nozzle 19 may have a single continuous slot outlet to deliver a low velocity curtain of molten metal directly into the nip 16A between the casting rolls 16. In either form, the nozzle 19 may be immersed in the molten metal pool between the casting rolls 16.

The casting pool of molten metal is confined at the ends of the rolls by a pair of side closure plates or dams 56 that are held against stepped ends 57 of the rolls when the roll cassette is in its operative position. Side closure plates 56, or dams are made of a strong refractory material and have contoured edges to match the curvature of the stepped ends of the rolls. The side closure plates 56 can be mounted in plate holders 82 which are movable by actuation of a pair of hydraulic cylinder units 83 to bring the side plates into engagement with the stepped ends of the casting rolls to form end closures for the molten pool of metal formed on the casting rolls during a casting operation and confine outflow of the casting pool of molten metal. Side closure plates 56 are adjacent the ends of the nip 16A, and confine the casting pool formed between the casting rolls 16.

During a casting operation the sliding gate valve 47 of the metal delivery system is actuated to allow molten metal to pour from the tundish 17 to the distributor 18 and through the metal delivery nozzle 19 whence it flows onto the casting rolls to form the casting pool with confinement of the side closure plates 56. The head end of the strip product 20 is guided by actuation of an apron table 96 to a pinch roll and thence to a coiling station (not shown). Apron table 96 hangs from pivot mountings 97 on the main frame and can be swung toward the pinch roll by actuation of an hydraulic cylinder unit (not shown) after the clean head end has been formed.

The removable roll cassette 13 is constructed as a module so that the casting rolls 16 can be set up and the gap of the nip 16A between them adjusted before the cassette is installed in position in the caster. The gap between the casting rolls at this point in assembly generally should be as small as possible without the casting rolls touching each other. Moreover when the cassette 13 is installed, a carrier drive system is provided with two pairs of carrier drive units 110 and 111 mounted on the main machine frame 11 that can be rapidly connected to roll carriers on the cassette 13 to provide forces resisting separation of the casting rolls. The carrier drive units may be roll biasing units or servo-mechanisms.

Figure 4:
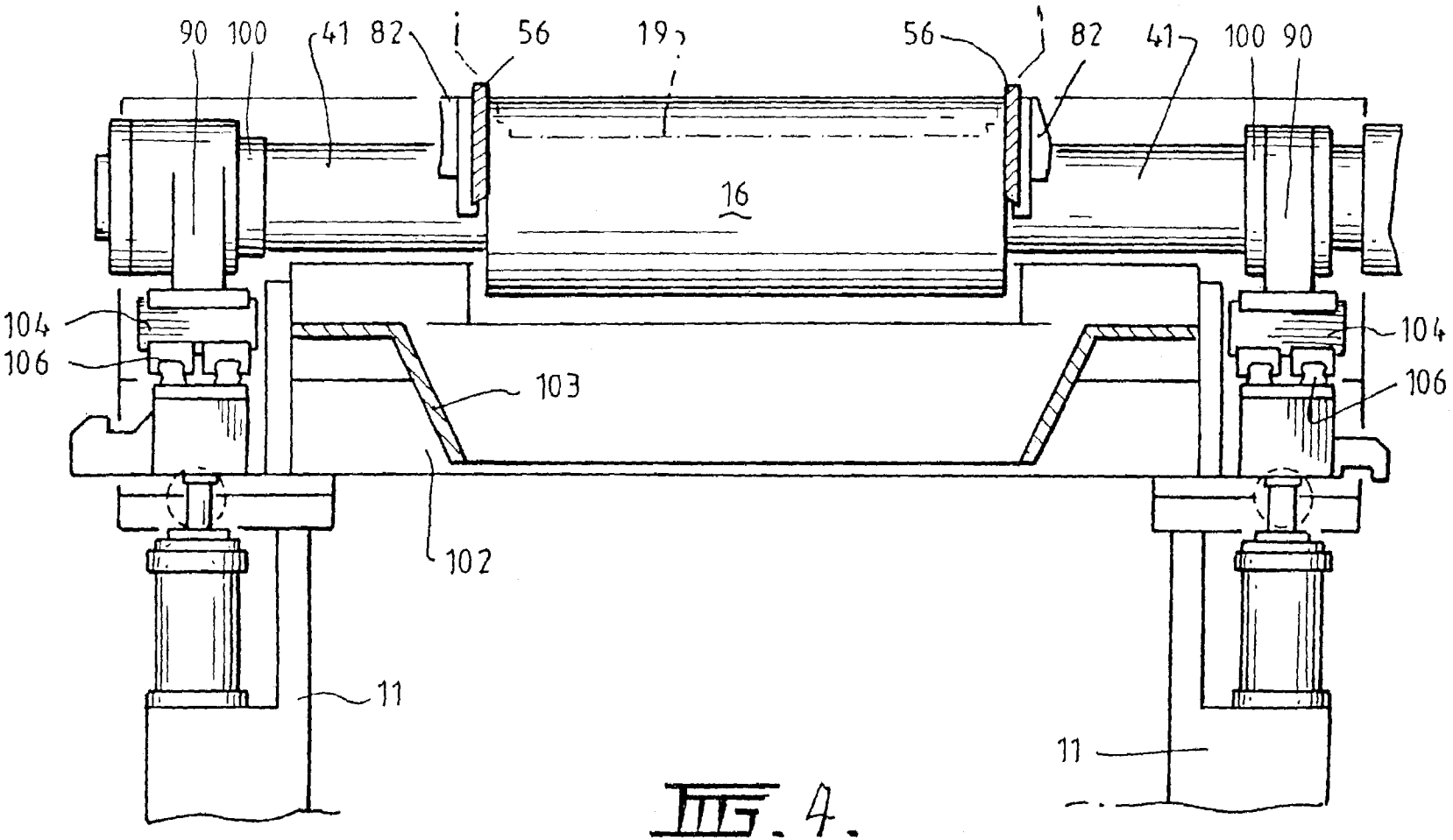
FIG. 4 is an end elevation of the caster.
Figure 5:
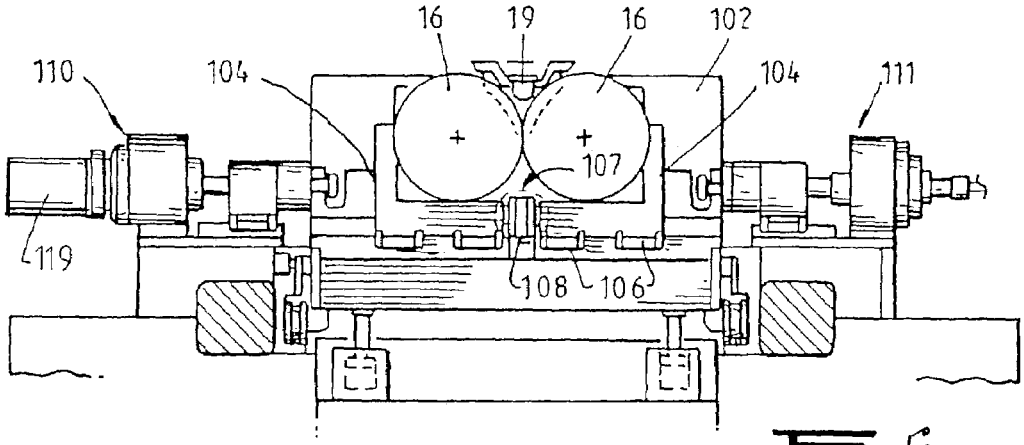
FIGS. 5, 6 and 7 show the caster in varying conditions during casting and during removal of the roll module from the caster.
Figure 6:
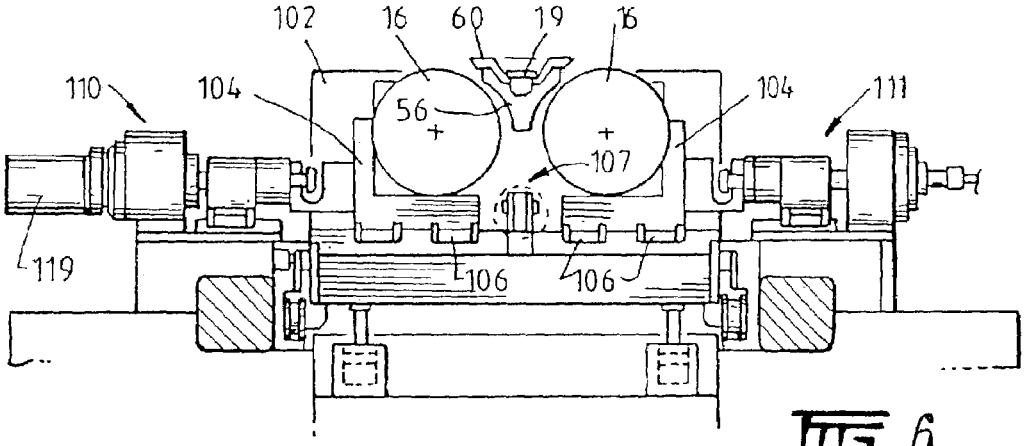
Figure 7:
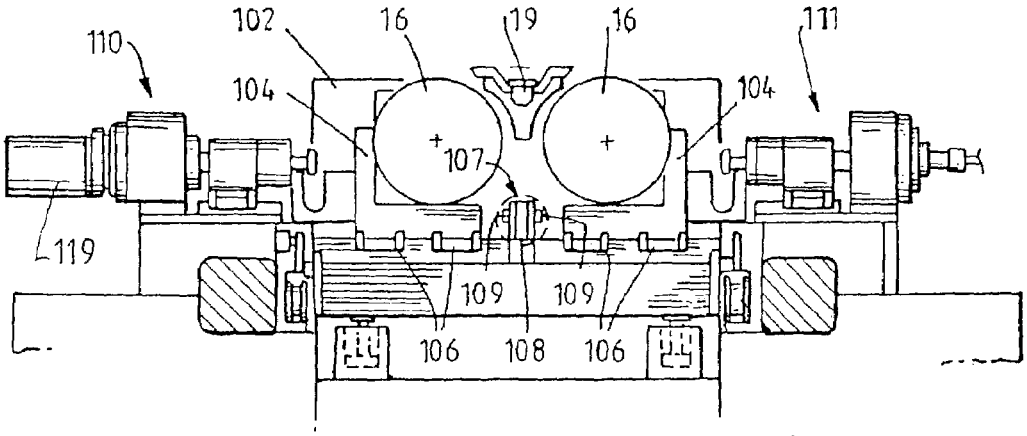

Roll cassette 13 comprises a large frame 102 that carries the casting rolls 16 and upper part 103 of the enclosure for enclosing the cast strip below the nip 16A. Casting rolls 16 are mounted on roll carriers 104 that comprise a pair of roll end support structures 90 (FIG. 4) carrying roll end bearings 100 by which the rolls are mounted for rotation about their longitudinal axis in parallel relationship with one another. The two pairs of roll carriers 104 are mounted on the roll cassette frame 102 by means of linear bearings 106. Each pair of roll carriers 104 can slide laterally of the cassette frame to provide for bodily movement of the casting rolls toward and away from one another, permitting separation and closing movement between the two parallel casting rolls 16.

Roll cassette frame 102 also carries two adjustable stops 107 disposed beneath the casting rolls 16 about a central vertical plane between the rolls and located between the two pairs of roll carriers 104 so as to serve as stops limiting inward movement of the two roll carriers 104 to define the minimum width of the gap at the nip 16A between the casting rolls 16. As explained below the roll carrier drives 110 and 111 are actuable to move the roll carriers 104 inwardly against these central adjustable stops, but to permit outward movement of one of the casting rolls 16 against preset forces.

Each adjustable stop means 107 is in the form of, for example, a worm or screw driven jack having a body 108 fixed relative to the central vertical plane of the caster and two ends 109 which can be moved on actuation of the driven jack equally in opposite directions to permit expansion and contraction of the jack to adjust the width of the gap at the nip 16A, while maintaining equidistant spacing of the casting rolls 16 from the central vertical plane of the caster and, also, a substantially constant gap between the casting rolls 16.

The carrier drive system is provided with two pairs of roll carrier drive units 110 and 111 each connected to a roll carrier 104 at each end of a casting roll 16. The carrier drive units 110 at one side of the caster are constructed and operate to be capable of moving one of the roll carriers and in turn varying the thickness of the strip across the strip width at the nip. These drives are comprised of servo-mechanisms (not shown) or compression springs 112 to provide lateral forces on the respective roll carriers 104. The carrier drives 111 at the other side of the caster move the roll carriers 104 supporting the other casting roll and incorporate hydraulic actuators 113. These actuators 113 are operable to hold the respective roll carriers 104 supporting one casting roll firmly against the central stops, while the other casting roll is free to move laterally with the action of the force of the servo-mechanism or compression springs 112 of the carrier drive units 110 to bias the casting rolls toward each other.

Figure 8:
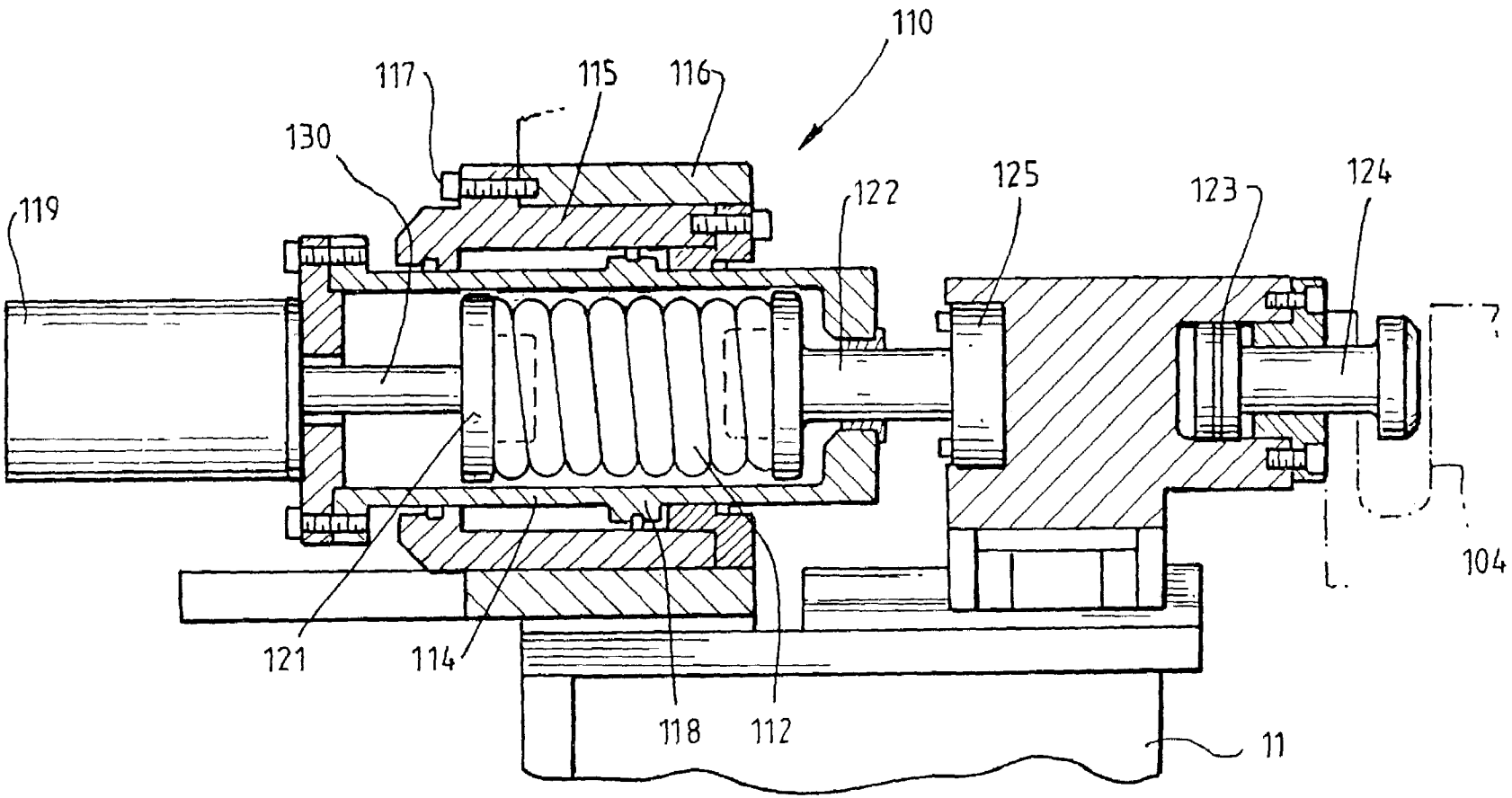
FIG. 8 is a vertical cross-section through a carrier drive unit incorporating a roll biasing spring.

The detailed construction of carrier drive units 110 are illustrated in FIG. 8, where units 110 are comprised of biasing units. As shown in that figure, each biasing unit comprises a compression spring 112 positioned in barrel housing 114 disposed within an outer housing 115, and is fixed to the main caster frame 116 by fixing bolts 117.

Spring housing 114 may be formed with a cylinder housing 118 positioned within the outer housing 115. Spring housing 114 may be set alternatively in an extended position as illustrated in FIG. 8 and a retracted position by flow of hydraulic fluid to and from the cylinder housing 118. The outer end of spring housing 114 carries a pressure fluid drive operable in the form of a hydraulic cylinder unit 119, and operable to set the position of a spring reaction plunger 121 connected to the piston of unit 119 by a connecting rod 130.

The other end of the compression spring 112 acts on a thrust transmission structure 122, which is connected to the respective roll carrier 104 through a load cell 125. The thrust structure is initially pulled into firm engagement with the roll carrier by a connector 124 that can be extended by operation of an hydraulic cylinder 123 when roll carrier drive units are to be disconnected.

When roll carrier drive units 110 are connected to the respective roll carrier 104, with the spring housing 114 set in its extended condition as shown in FIG. 8, the position of the spring housing 114 and cylinder unit 119 is fixed relative to the caster frame. The position of the spring reaction plunger 121 can be set to adjust the effective gap between the spring abutments on the reaction plunger 121 and the thrust transmission structure 122. The compression of the spring 112 can thereby be adjusted to vary the thrusting force applied to the thrust transmission structure 122 and the respective roll carrier 104. With this arrangement the only relative movement during casting operation is the movement of the roll carrier 104 and thruster structure 122 as a unit against the compression spring. Alternatively, the same force exerted by the compression spring on the roll carrier 104 can be exerted by a servo-mechanism. In either case, the force exerted by the roll carrier drives 110 on the roll carrier 104 inwardly against the stop can be adjusted to preload the roll carrier 104 with a required inward force before metal strip actually passes between the casting rolls, and that force can be maintained during a subsequent casting operation.

Hydraulic cylinder unit 119 may be operated continuously to vary the position of the spring reaction plunger to replicate movements of the thrust transmission structure 122 due to variations in strip thickness and resulting lateral movements of the roll carrier 104. Any inward or outward movement of roll carrier 104 will cause a corresponding inward or outward movement of the cylinder of cylinder unit 119 and spring reaction plunger 121 so as to maintain a constant compression of the compression spring 112.

Accordingly, a substantially constant biasing force can be maintained against the carrier 104 and in turn the supported casting roll 16 at each end of the roll regardless of movements of the roll mountings. Previously available pressure fluid systems are not used because they are generally too slow in response time. The use of compression springs or servo-mechanisms in combination with a continual control setting device as explained herein enables very accurate setting of controlled forces which can be maintained or varied throughout a casting operation. The compression springs of the carrier drive units may be very low stiffness springs, or, alternatively, sensitive servo-mechanisms may be used because the two roll carrier drive units of the carrier drive system at the two ends of the laterally moveable casting roll operate independently so that there need be no cross-talk between them.

Accordingly, this arrangement allows the roll biasing force to be reduced to a very low level in accordance with the present invention. Generally there is a minimum force that is required to balance the hydrostatic pressure of the casting pool (approximately 0.75 kN per side in a 500 mm diameter twin roll caster and 1350 mm roll width) and to overcome the mechanical friction involved in moving the casting rolls (less than approximately 0.6 kN per side in a 500 mm diameter twin roll caster). This results in a practical low biasing force level, which may be in the range of 0.75 to 2 kN.

Figure 9:
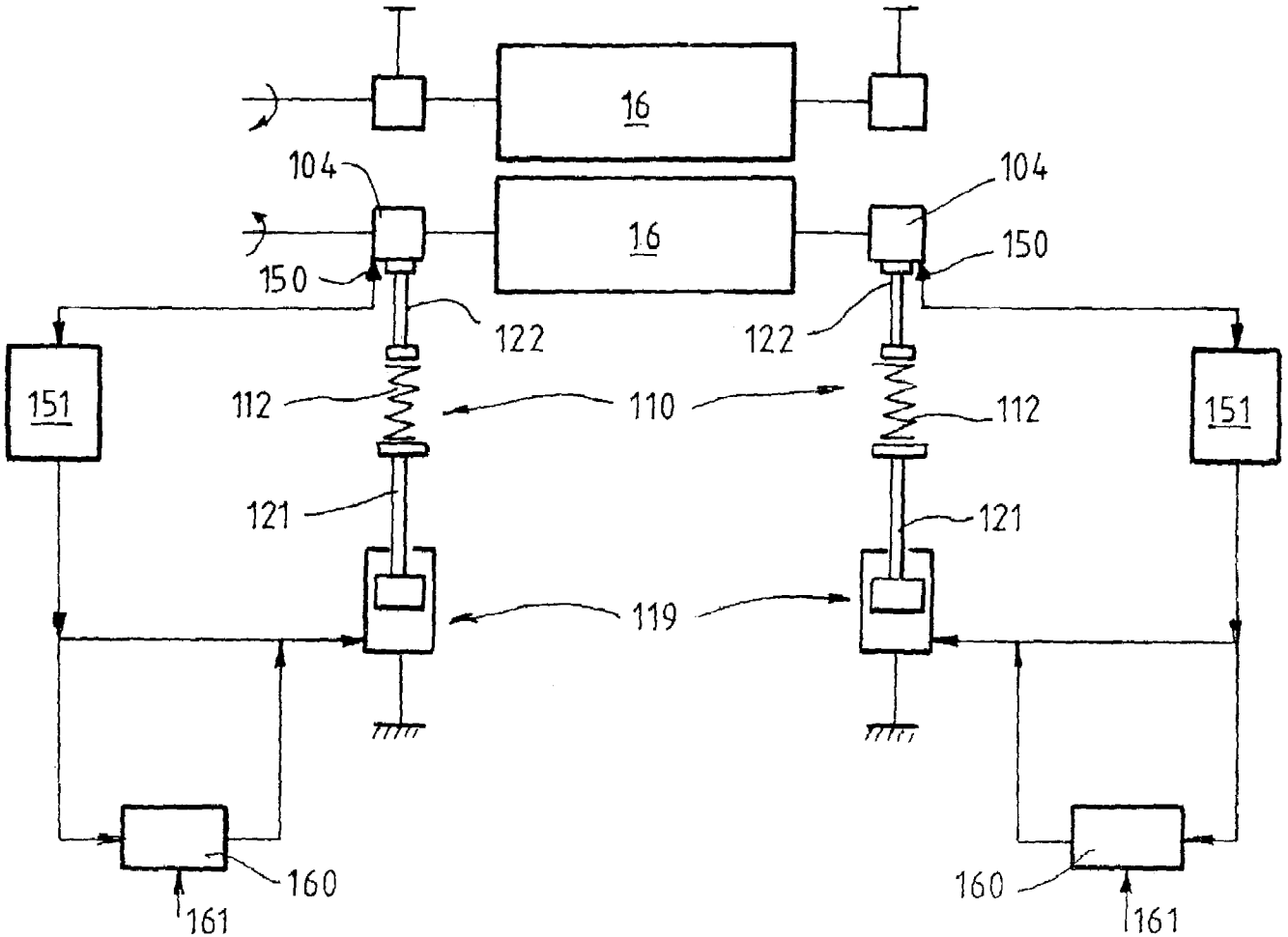
FIG. 9 is a schematic representation of various components of the caster.

As illustrated diagrammatically in FIG. 9, an exemplary control system can be comprised of position sensors 150, sensing the position of the thrust transmission structures 122 and connected into a control circuit which controls the operation of the cylinder unit 119 so that the movements of the thrust transmission structures 122 are replicated by the cylinders of units 119. The control system may comprise controllers 151 connected to the position sensors 150 and to the cylinder units 119 to operate the cylinders 119 so as to replicate movements of the thrust transmission structures 122. Controllers 151 also control operation of the cylinders for initial setting of the roll carriers prior to casting and subsequent adjustment to add a similar incremental movement of the cylinders 119 through step controllers 160 to maintain the constant biasing force, and to increase the gap at the nip 16A between the casting rolls 16, so as to produce a gap between the rolls 16 at the nip 16A that is greater than the gap determined by the solidified shell thickness in casting. The step controllers have a set point input at 161.

Figure 11:
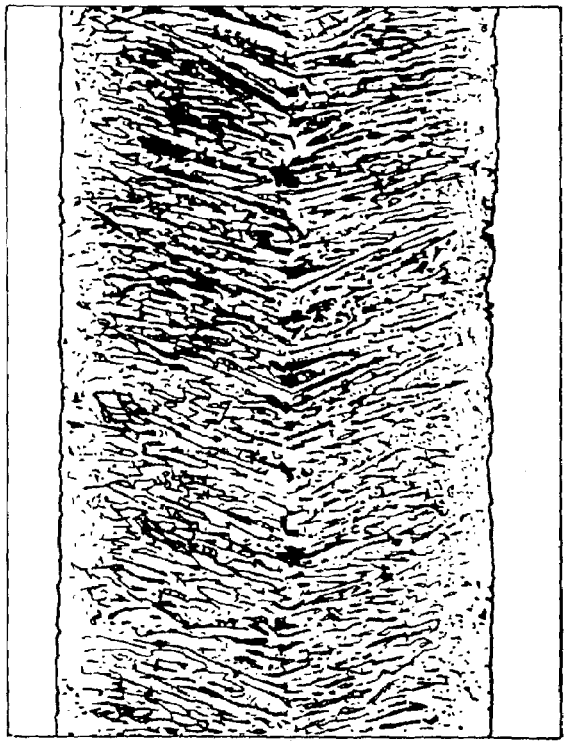
FIG. 11 is a cross-section of a cast steel strip of the prior art illustrated for purposes of comparison.

Typically in accordance with the illustrated embodiments, the system may be operated to maintain a gap at the nip 16A between the casting rolls 16 greater than the gap determined by the solidified shell thickness. In operation of the illustrated system, casting commences with a gap initially determined by the solidified shell thickness. This thickness is illustrated by FIG. 11 where the dendrites of the solidified shells of the strip join in the formed strip. Movement of the roll carriers due to remaining roll eccentricities are sensed by the sensors 150 and the control unit learns the pattern of roll movements due to that eccentricity. In order to compensate for the eccentricity induced force fluctuation, the roll chock trajectories are replicated at the spring reaction structures by the position control system and those compensatory movements are continued. The roll gap is then increased by a small amount (such as for example 0 to 50 microns) while the pattern of movements of the spring reaction structure is continued. This even further enhances the already formed substantially constant gap between the casting rolls by further reducing if not eliminating force fluctuation induced by roll eccentricity compensation.

Illustratively, in the control system illustrated in FIG. 9, the step of increasing the gap at the nip 16A between the casting rolls 16 is achieved by moving the roll carriers supporting the spring biased roll and the hydraulically actuated biasing units for the other roll are operated to lock the other roll in a fixed position. The system of the present invention can be used in combination with the eccentricity control system described in our co-pending U.S. patent application Ser. No. 10/104,313, which description now is incorporated herein by reference. In that system, the thickness variations due to roll eccentricity can be very much reduced by imposing a pattern of speed variations in the speed of rotation of the casting rolls. Compensation in this manner is possible because even small variations vary the time of contact of the solidifying metal shells on the casting rolls within the casting pool, and therefore affect the strip thickness and roll thermal load to facilitate the production of strip of constant thickness. If this form of eccentricity control is adopted, this will reduce the amplitude of the initial roll carrier fluctuations and the need for compensatory movements within the minimal force/constant gap system of the present invention. The present invention also provides enhanced productivity.

Figure 10:
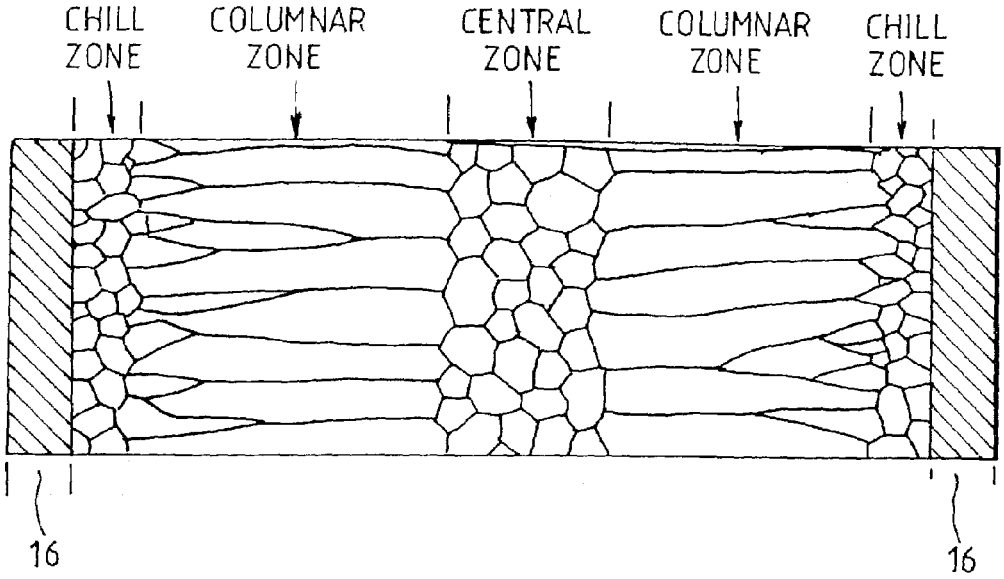
FIG. 10 is a cross-section of a cast steel strip made as described by the present invention.

Referring to FIG. 10, unique steel product made by the presently described method is illustrated. The unique cast steel strip is made by the following steps of assembling a pair of cooled casting rolls having a nip between them and confining closures adjacent the ends of the nip, introducing molten metal between said pair of casting rolls to form a casting pool between the rolls with the closures confining the pool adjacent the ends of the nip, rotating the rolls such that shells of metal solidify from the casting pool onto the casting rolls and are brought close together at the nip to produce a solidified strip delivered downwardly from the nip, biasing at least one of the pair of casting rolls toward the other roll of the pair under a biasing force and maintaining a substantially constant gap between the rolls at the nip sufficient to provide separation between the solidified shells at the nip, preferably with the biasing force creating a roll separation force less than 0.45 kN, and passing molten metal between the solidified shells through the nip where at least a portion of said molten metal is solidified in the strip below the nip. The columnar dendrite structure of steel formed in the solidified shells onto the casting rolls 16 do not come together. This is illustrated by comparison in FIG. 11, where the structure of steel strip made by the previously described strip casting process is illustrated. There the columnar dendrite structure of the solidified shell join in the formed strip as the solidified shells come together. However, in steel strip made in accordance with the present invention, there is a central zone within the steel strip between the solidified shells that solidifies after strip passes through the gap between the casting rolls 16 at the nip 16A.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. An apparatus for continuously casting metal strip comprising:

a pair of parallel casting rolls forming a nip between them, a metal supply system to deliver molten metal into the nip between the rolls to form a casting pool of molten metal supported on casting roll surfaces immediately above the nip, a pair of closure plates to confine the molten metal in the casting pool against outflow adjacent the ends of the nip, a roll drive mechanism to drive the casting rolls in counter-rotational directions to produce a solidified strip of metal delivered downwardly from the nip, at least one of the casting rolls mounted on a pair of moveable roll carriers that allow that roll to move toward and away from the other roll, a pair of carrier drive units acting one on each of the pair of moveable roll carriers to bias said one roll toward the other roll, a control system to control operation and capable of positioning of the carrier drive units so as to maintain a substantially constant gap in response to position sensors between the rolls sufficient to provide separation at the nip between solidified shells formed on the casting rolls during casting in response to roll eccentricities.

2. The apparatus of claim 1 wherein the carrier drive units comprise servo-mechanisms.

3. The apparatus of claim 1 wherein the carrier drive units comprise roll biasing units comprising:

a thrust transmission structure connected to the respective roll carrier, a thrust reaction structure, a thrust generator acting between the thrust reaction structure and the thrust transmission structure to exert a thrust on the thrust transmission structure and the respective roll carrier, and a positioning unit operable to vary the position of the thrust reaction structure, wherein the control system is configured to control operation of the positioning unit so as to replicate a pattern of movement of the roll carriers due to roll eccentricities as an applied pattern of movements of the thrust reaction structure to maintain a constant roll biasing force and to increase the gap between the rolls after said applied pattern of movements has been established.

4. The apparatus as claimed in claim 1, wherein the control system is operable to produce an incremental increase of the gap between the rolls in the range of 0 to 50 microns.

5. The apparatus as claimed in claim 1, wherein control system is operable to move said one roll.

6. An apparatus for continuously casting metal strip comprising:

a pair of parallel casting rolls forming a nip between them, means for delivering molten metal into the nip between the rolls to form a casting pool of molten metal supported on casting roll surfaces immediately above the nip, means for confining the molten metal in the casting pool against outflow adjacent the ends of the nip, a roll drive to drive the casting rolls in counter-rotational directions to produce a solidified strip of metal delivered downwardly from the nip, at least one of the casting rolls mounted on a pair of moveable roll carriers that allow that roll to move toward and away from the other roll, a pair of roll biasing units acting one on each of the pair of moveable roll carriers to bias said one roll toward the other roll capable of maintaining a substantially constant gap between the rolls sufficient to provide separation between solidified shells at the nip formed on the casting rolls during casting, each roll biasing unit comprising:

a thrust transmission structure connected to the respective roll carrier, a thrust reaction structure, a thrust generator acting between the thrust reaction structure and the thrust transmission structure to exert a thrust on the thrust transmission structure and the respective roll carrier, means for varying the position of the thrust reaction structure, and means for controlling the means for varying the position of the thrust reaction structure so as to replicate a pattern of movement of the roll carriers due to roll eccentricities as an applied pattern of movements of the thrust reaction structure to maintain a constant roll biasing force, and means for controlling the roll gap to increase the gap between the rolls after said applied pattern of movements has been established.

7. The apparatus as claimed in claim 6, wherein the means for controlling the roll gap is operable to produce an incremental increase of the roll gap in the range of 0 to 50 microns.

8. The apparatus as claimed in claim 6, wherein the means for controlling the roll gap is operable to move said one roll.

9. The apparatus as claimed in claim 6, wherein the means for delivering molten metal comprises a ladle.

10. The apparatus as claimed in claim 6, wherein the means for delivering molten metal further comprises a tundish.

11. The apparatus as claimed in claim 10, wherein the means for delivering molten metal further comprises a distributor.

12. The apparatus as claimed in claim 11, wherein the means for delivering molten metal further comprises a nozzle.

13. The apparatus as claimed in claim 6, wherein the means for confining the molten metal comprises one or more side closure plates.

14. The apparatus as claimed in claim 6, wherein the roll drive comprises a motor.

15. The apparatus as claimed in claim 6, wherein the thrust generator comprises a compression spring.

16. The apparatus as claimed in claim 6, wherein the thrust generator comprises a pressure fluid cylinder unit.

17. The apparatus as claimed in claim 6, wherein the means for varying the position of the thrust reaction structure comprises a hydraulic unit.

18. The apparatus as claimed in claim 6, wherein the means for controlling the means for varying the position of the thrust reaction structure comprises a control system.

19. The apparatus as claimed in claim 18, wherein the control system comprises one or more position sensors.

20. The apparatus as claimed in claim 19, wherein the control system further comprises one or more control circuits to control the operation of the means for varying the position of the thrust reaction structure.

21. The apparatus as claimed in claim 20, wherein the one or more control circuits comprise one or more controllers.

22. The apparatus as claimed in claim 6, wherein the means for controlling the roll gap comprises the control system.

23. The apparatus as claimed in claim 22, wherein the means for controlling the roll gap further comprises an adjustable stop.

* * * * *